United States Patent [19]

Hayashi et al.

[11] 4,128,087

[45] Dec. 5, 1978

[54] THROTTLE VALVE OPERATING MECHANISM

[75] Inventors: Makio Hayashi; Takashi Hisatomi, both of Yokohama, Japan

[73] Assignee: Nissan Motor Company, Limited, Japan

[21] Appl. No.: 810,792

[22] Filed: Jun. 28, 1977

[30] Foreign Application Priority Data

Jun. 30, 1976 [JP] Japan ..... 51-85929[U]

[51] Int. Cl.[2] ..... F02D 11/08

[52] U.S. Cl. ..... 123/103 E; 123/102; 123/103 R; 123/DIG. 11

[58] Field of Search ..... 123/102, 103 E, 103 R, 123/102 R, 97 R, DIG. 11; 261/DIG. 18, DIG. 19

[56] References Cited

U.S. PATENT DOCUMENTS

| | | | |
|---|---|---|---|
| 3,881,685 | 5/1975 | Hase et al. | 123/103 E |
| 4,056,082 | 11/1977 | Noiles | 123/103 R |

*Primary Examiner*—Ronald H. Lazarus

[57] ABSTRACT

A throttle valve operating mechanism according to the invention has two functions one of which is a dashpot function to dampen the closing rotation of the throttle valve of the carburetor thereby achieving reduction of harmful compounds such as HC and CO contained in the exhaust gases from the internal combustion engine during deceleration of the same and the other of which is to open the throttle valve by a predetermined amount from the initially set nearly closed position when an engine driven power consuming device such as air-conditioner compressor starts to run during idling of the engine. This throttle valve operating mechanism is very compactly made by employing integrated construction.

10 Claims, 3 Drawing Figures

THROTTLE VALVE OPERATING MECHANISM

FIELD OF THE INVENTION

The present invention relates in general to a throttle valve operating mechanism for a carburetor of an internal combustion engine, and more particularly to a throttle valve operating mechanism by which, under idling of the engine, the throttle valve is slightly more open by a predetermined amount from the initially set idling position thereof to increase the engine output power when an engine driven power consuming device such as an air-conditioner compressor begins to run. Furthermore, the present invention is concerned with a throttle valve operating mechanism which functions as a dashpot to dampen the fast closing rotation of the throttle valve thereby achieving reduction of harmful compounds such as hydrocarbons (HC) and carbon monoxide (CO) contained in the exhaust gases emitted from the engine under deceleration of the same.

BACKGROUND OF THE INVENTION

In a motor vehicle equipped with an engine driven power consuming device such as an air-conditioner compressor, it has heretofore been proposed that, under idling condition of the engine, the opening degree of the throttle valve of the carburetor is slightly more increased to feed the engine with a larger amount of air-fuel mixture when such power consuming device starts to run. This is to increase the engine output power to prevent stalling of the engine under such loaded idling condition.

One of the conventional mechanisms materializing the above is a so-called "Fast Idle Control Device (FICD)" which is arranged such that, when the power consuming device begins to run, an intake vacuum of the engine is fed into a vacuum motor, which is mechanically connected to the throttle valve, for slightly increasing the opening degree of the throttle valve.

Apart from this, in the conventional internal combustion engine, it has also been proposed to have a carburetor equipped with a dashpot which functions to prevent the throttle valve from being closed too fast after an acceleration pedal is released for thereby not only effecting smooth deceleration of the engine but also reducing harmful compounds such as hydrocarbons (HC) and carbon monoxide (CO) in the exhaust gases emitted from the engine.

However, in the conventional engine system equipped with the above-mentioned two mechanisms separately, a drawback that the intake section of it becomes bulky and complicated is encountered with the engine system.

SUMMARY OF THE INVENTION

Accordingly, an object of the present invention is to provide a compact throttle valve operating mechanism which has the two functions of the above-mentioned two mechanisms.

Another object of the present invention is to provide a throttle valve operating mechanism which is simple in construction and economical to manufacture.

Still another object of the present invention is to provide a throttle valve operating mechanism which can be readily installed in existing engine carburetors.

SUMMARY OF THE DRAWINGS

Other objects and advantages of the present invention will become more apparent from the following description when taken in conjunction with the accompanying drawings, in which.

DESCRIPTION OF THE PREFERRED EMBODIMENT

Figure 1:
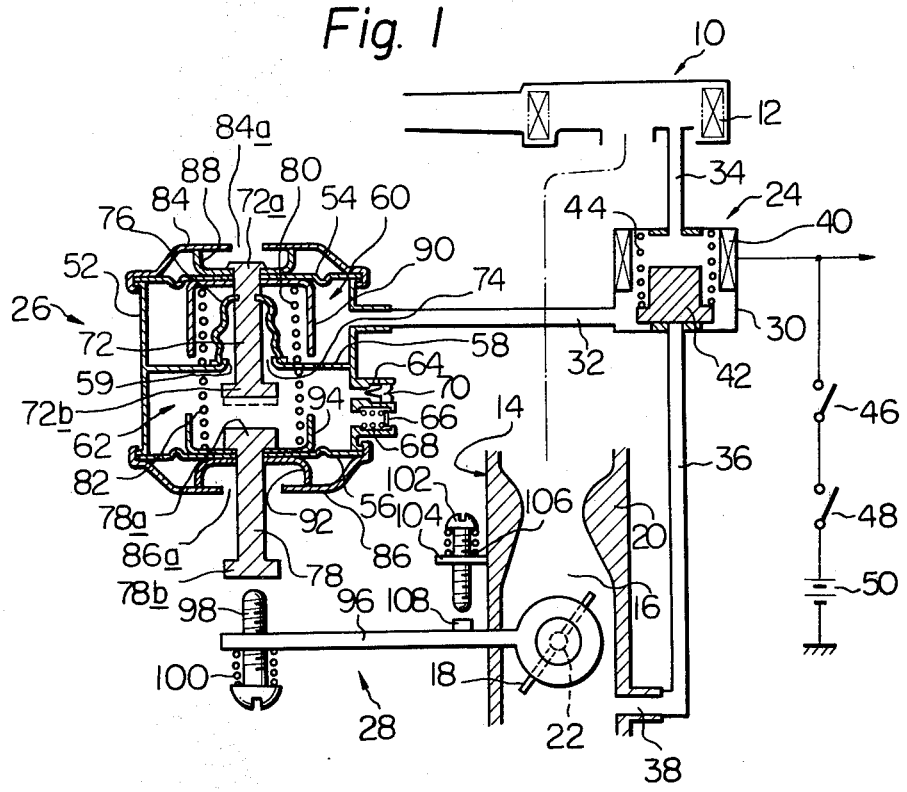
FIG. 1 is a sketch of a throttle valve operating mechanism according to the present invention, the mechanism being shown as incorporated in a conventional carburetor of an internal combustion engine.

Referring to FIG. 1 of the drawings, there is illustrated a throttle valve operating mechanism implementing the present invention. The mechanism proposed by the invention is incorporated with an intake conduit system of an internal combustion engine of a motor vehicle.

The intake conduit system shown in the drawing comprises an air filter 10 containing therein a filter element 12, and a carburetor 14 having therein an air-fuel mixture passage 16 and a throttle valve 18 located downstream of a venturi portion 20. The throttle valve 18 is fixedly mounted on a throttle shaft 22 for rotational movement therewith. Although not shown in the drawing, biasing means such as a spring is employed in the carburetor 14 for biasing the throttle valve 18 to close the air-fuel mixture passage 16, that is, in a clockwise direction as viewed in the drawing.

The throttle valve operating mechanism incorporated with the intake conduit system generally comprises switching means 24, diaphragm means 26 and linkage means 28.

The switching means 24 is, for example, an electromagnetic three-way valve comprising a body 30 in which a chamber (no numeral) is defined. The chamber is fluidly communicable through first, second and third conduits 32, 34 and 36 with the diaphragm means 26, the clean side of the air filter 10 and a vacuum port 38 open to the air-fuel mixture passage 16 downstream of the throttle valve 18, respectively. Within the chamber of the body 30 are disposed a coil 40 having one end connected to a later-mentioned switch 46 and the other end grounded, a movable valve head 42, and a spiral spring 44 for biasing the valve head 42 in a direction to close the conduit 36. The valve head 42 is shifted against the force of the spring 44 to close the conduit 34 and simultaneously open the conduit 36 when the coil 40 is electrically energized.

Connected to one end of the coil 40 is a switch of a power consuming device such as an air-conditioner compressor (not shown). Indicated by numeral 48 is an ignition switch of the engine which is interposed between the switch 46 and a battery 50, the negative pole of the battery 50 being grounded as shown.

From the above, it will be appreciated that when either of the switches 46 and 48 is open causing standstill of the air conditioner compressor, the valve member 42 blocks the communication between the diaphragm means 26 and the vacuum port 38 and simultaneously opens the communication between the diaphragm means 26 and the clean side of the air-filter 10.

On the contrary, when these switches 46 and 48 are both closed inducing operation of the air-conditioner compressor, the valve member 42 is shifted to block the communication between the diaphragm means 26 and the clean side of the airfilter 10 and simultaneously open the communication between the diaphragm means 26 and the vacuum port 38.

The diaphragm means 26 comprises a cylindrical casing 52 the axial open ends of which are respectively and sealingly covered with first and second diaphragms 54 and 56. A partition member 58 is integrally disposed in the cylindrical casing 52 to divide the same into first and second chambers 60 and 62. The first chamber communicates with the chamber of the before-mentioned three-way valve 24. The second chamber 62 communicates with the atmosphere through an orifice 64 formed in a short passage (no numeral) merged with the second chamber 62 and is communicable with the atmosphere through a check valve 66 backed by a spring 68. Indicated by numeral 70 is an adjusting screw which changes the opening formed in the short passage when rotated.

Figure 2:
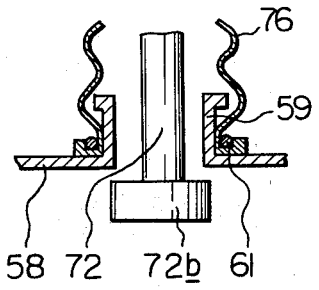
FIG. 2 is an enlarged sectional view illustrating a structural part of the mechanism shown in FIG. 1.

Connected at its upper end **72*a* to the first diaphragm 54 is a first rod 72 which is projected at its enlarged lower end 72*b* into the second chamber 62 through an opening 74 formed in the partition member 58. A sealing member 76 in the form of bellows is fixed at its one end to the rod 72 and at its other end to a flange portion 59 defining the opening 74 of the partition member 58 so that the first and second chambers 60 and 62 are completely isolated from each other. The manner of connection between the sealing member 76 and the flange portion 59 is well shown in FIG. 2 in which a ring 61 is illustrated to sealingly fix the other end of the sealing member 76 to the flange portion 59**.

Connected at its upper end **78*a* to the second diaphragm 56 is a second rod 78 which extends downwardly forming an enlarged lower end 78*b*. As will be noted hereinlater, the enlarged lower end 72*b* of the first rod 72 is engageable with the enlarged upper end 78*a* of the second rod 78. First and second spiral springs 80 and 82 are respectively disposed in the first and second chambers 60 and 62 for biasing the first and second diaphragms 54 and 56 upwardly and downwardly of this drawing, respectively. First and second covers 84 and 86 with respective central openings 84*a* and 86*a* are fixed to the cylindrical casing 52 so as to respectively and spacedly cover the first and second diaphragms 54 and 56, as shown. First and second stoppers 88 and 90 in the form of cylinder are connected to the first diaphragm 54 to respectively extend upwardly and downwardly. With these stoppers, the upward and downward movements of the first diaphragm 54 are limited. Now, it should be noted that the first stopper 88 is kept engaged by the assistance of the spring 80 with the first cover 84 to hold the first diaphragm 54 at its upper most position when the first chamber 60 communicates with the atmosphere. Third and fourth stoppers 92 and 94 in the form of cylinder are connected to the second diaphragm 56 so as to respectively extend downwardly and upwardly as shown. With these stoppers 92 and 94, the downward and upward movements of the second diaphragm 56 are limited. As will be understood hereinlater, the second chamber 62 can act as a dashpot which operates to dampen the closing rotational movement of the throttle valve 18**.

Figure 3:
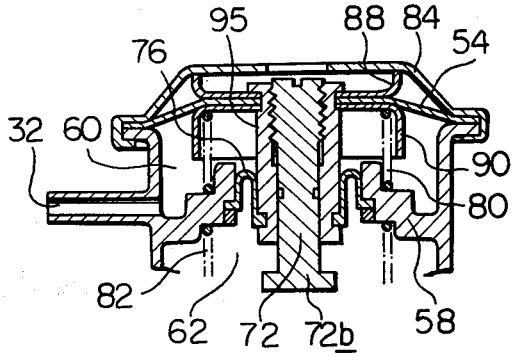
FIG. 3 is an enlarged sectional view of a modified form of another structural part of the mechanism shown in FIG. 1.

FIG. 3 shows a modified form of the diaphragm means 26 shown in FIG. 1. In the modified diaphragm means, the position of the first rod 72 with respect to the first diaphragm 54 is adjustable by only rotating the rod 72. For this, the first rod 72 is screwed or threaded in a sleeve 95 which is connected at its upper end to the first diaphragm 54 and at its lower portion with the sealing member 76.

The linkage means 28 comprises an arm 96 which has one end fixed to the throttle shaft 22 and the other end carrying thereon a throttle adjusting screw 98, which is threaded in the arm 96 and held in any adjusted position by a retaining spring 100. Indicated by numeral 102 is an adjustable stop screw which is threaded in a laterally projecting flange 104 and held in any adjusted position by a retaining spring 106. The stop screw 102 is adapted to be engageable at its terminal end with a projection 108 on the arm 96 so that an excessive rotation of the arm 96 toward closing direction of the throttle valve 18 is prevented.

With the above-stated construction of the throttle valve operating mechanism of the invention, the operation is as follows:

When the accelerator pedal is released to cause deceleration or idling of the engine, the throttle valve 18 with the arm 96 is forced to rotate clockwise by the action of the spring (not shown) fixed to the throttle shaft 22 in a direction to close the air-fuel mixture passage 16. However, upon engagement of the throttle adjusting screw 98 with the enlarged lower end **78*b* of the second rod 78, the speed of the clockwise rotation of the arm 98 and thus the throttle valve 18 is decreased or dampened. This is due to the fact that, in such a condition, the air in the second chamber 62 is expelled into the open air only through the orifice 58 in response to the upward movement of the second diaphragm 56 together with the second rod 78 compelled by the rotating arm 96. This dampening effect continues until the projection 108 on the arm 96 or the enlarged upper end 78*a* of the second rod 78 engages with the terminal end of the stop screw 102 or the enlarged lower end 72*b* of the first rod 72 as will be well described hereinlater. (Under this, the fourth stopper 94 may not be engaged with the partition member 58.) This dampening effect is sufficiently achieved regardless of the operation of the switching means 24**. It should also be noted that such dampening effect induces not only smooth deceleration of the engine but also considerable reduction of harmful compounds such as CO and HC in the exhaust gases emitted from the decelerating engine.

However, in response to OFF or ON condition of the switch 46 of the air-conditioner compressor under running of the engine wherein the ignition switch 48 closes, the operation of the throttle valve operating mechanism is changed as follows.

Under running of the engine wherein the ignition switch 48 closes, when the switch 46 is open suspending operation of the air-conditioner compressor, the switching means or three-way valve 24 takes the illustrated position (in FIG. 1) wherein the fluid communication between the clean side of the air-filter 10 and the first chamber 60 of the diaphragm means 26 is accomplished. Under this circumstance, the first diaphragm 54 is held in one extreme position, that is, in the uppermost position as shown in FIG. 1 by the action of the first spring 80 while holding the first rod 72 in its uppermost position. Under this, the engagement of the projection 108 with the stop screw 102 takes place when the throttle valve 18 is held in the nearly closed position wherein the engine normally idles.

Under this circumstance, when the switch 46 is closed for starting the air-conditioner compressor, the switching means or three-way valve 24 provides a fluid connection between the vacuum port 38 positioned downstream of the throttle valve 22 and the first chamber 60 of the diaphragm means 26 and simultaneously blocks the communication between the clean side of the airfilter 10 and the first chamber 60. The first diaphragm 54 is thus moved downwardly together with the first rod 72 because of vacuum fed from the vacuum port 38 into the first chamber 60. Thus downward movement of the first diaphragm 54 continues until the second stopper 90 engages with the partition member 58. Thus, the first rod 72 is held in its extreme position, that is, in the lower most position thereof as shown by a dotted line in FIG. 1. In this condition, an engagement of the enlarged upper end 78*a* of the second rod 78 with the enlarged lower end 72*b* of the first rod 72 occurs before the projection 108 contacts the stop screw 102. This means that the returning and dampening rotation of the throttle valve 18 is stopped at a position where the opening degree of the valve 18 is larger than that in the above-mentioned normally idling engine. Thus, a greater amount of air-fuel mixture is supplied into the engine to increase engine idling speed or output power to secure smooth running of the engine even under such an additionally loaded condition.

It should be noted that the timing when the dampening effect applied to the throttle valve 18 becomes effective is readily changed by screwing the adjusting screw 98. Furthermore, if the modified diaphragm means shown in FIG. 3 is employed, the degree of opening of the throttle valve 18 at the additionally loaded condition of the engine can be readily adjusted by screwing the exteriorly threaded first rod 72.

In addition to the above-mentioned construction, the following several modifications may be possible in the present invention:

Although in the previous description, it has been explained that the movement of the first diaphragm 54 is caused by the vacuum force exerted in the air-fuel mixture passage 16 downstream of the throttle valve 18, it may be possible to use a positive pressure of an air pump. In this case, of course, the diaphragm means 26 is constructed to move the first diaphragm 54 downwardly, that is, toward the second chamber 62 of FIG. 1 in response to the positive pressure feed thereto.

Furthermore, the switch 46 for the air-conditioner compressor may be constructed to automatically close or open in response to the operative or inoperative condition of the air-conditioner compressor.

What is claimed is:

1. A throttle valve operating mechanism for a carburetor having an intake passage containing therein a throttle valve which is biased to close said passage, said mechanism comprising:

a casing having therein a partition wall;

first and second movable walls covering respective open ends of said casing so as to define in said casing first and second chambers, said second chamber communicating through a flow restrictor with the atmosphere;

first and second biasing means respectively disposed in said first and second chambers for biasing said first and second movable walls in directions to separate from each other;

position setting means for setting the extreme position of said second movable wall in response to the movement of said first movable wall, the expansion of said first chamber inducing a first extreme position of said second movable wall and the contraction of said first chamber inducing a second extreme position of said second movable wall;

transmitting means for controlling the throttle valve in such a manner that said throttle valve is nearly fully closed when said second movable wall takes said first extreme position, and said throttle valve is opened by a predetermined amount from said nearly closed position when said second movable wall takes said second extreme position; and switching means for providing a fluid communication between said first chamber and the atmosphere to achieve the expansion of said first chamber when an engine driven power consuming device stops to run, and a fluid communication between said first chamber and a vacuum source to achieve the contraction of said first chamber when said engine driven power consuming device begins to run.

2. A throttle valve operating mechanism as claimed in claim 1, in which said first and second movable walls are diaphragms.

3. A throttle valve operating mechanism as claimed in claim 1, in which said position setting means comprises a first rod having one end connected to said first movable wall and the other end projected through an opening formed in said partition wall into said second chamber; a sealing member for sealing a clearance between said first rod and said opening; and a second rod connected to said second movable wall and having one end projected into said second chamber to be contactable with the other end of said first rod and the other end extending outwardly from said casing.

4. A throttle valve operating mechanism as claimed in claim 3, in which said transmitting means comprises an arm member having one end connected to a shaft of said throttle valve to be rotatable therewith and the other end engageable with the other end of said second rod.

5. A throttle valve operating mechanism as claimed in claim 4, in which the other end of said arm member is equipped with an adjusting screw by which the engaging timing of the other end of said arm member with the other end of said second rod is changeable.

6. A throttle valve operating mechanism as claimed in claim 5, further comprising stopping means for preventing excess inward and outward movements of said first and second movable walls

7. A throttle valve operating mechanism as claimed in claim 6, in which said stopping means comprises first and second covers respectively and spacedly covering said first and second movable walls while connecting to said casing; a first member connected to said first movable wall and extending toward the first cover; a second member connected to said first movable wall and extending toward said partition wall; a third member connected to said second movable wall and extending toward said second cover; and a fourth member connected to said second movable wall and extending toward said partition wall.

8. A throttle valve operating mechanism as claimed in claim 1, in which said switching means comprises an electromagnetic three-way valve which is arranged to selectively provide a fluid communication between said first chamber and the clean siad of an air-filter when electrically de-energized in response to opening of a switch of said engine driven power consuming device and a fluid communication between said first chamber and an interior of the carburetor intake passage downstream of said throttle valve when electrically energized in response to closing of said switch.

9. A throttle valve operating mechanism as claimed in claim 3, further comprising an interiorly threaded sleeve which is concentrically mounted on a threaded portion formed on said first rod while being fixed to said first movable wall so that the distance between the other end of said first rod and said first movable wall is changeable by adjusting said first rod.

10. A throttle valve operating mechanism as claimed in claim 1, in which said engine driven power consuming device is a compressor of an air-conditioner.

* * * * *